US005970285A

United States Patent [19]

Ito et al.

[11] Patent Number: 5,970,285

[45] Date of Patent: Oct. 19, 1999

[54] CLEANERLESS IMAGE FORMING APPARATUS

[75] Inventors: Nobuyuki Ito, Shizuoka-ken; Hiroyuki Suzuki, Yokohama, both of Japan

[73] Assignee: Canon Kabushiki Kaisha, Tokyo, Japan

[21] Appl. No.: 08/832,861

[22] Filed: Apr. 4, 1997

[30] Foreign Application Priority Data

| | | | |
|---|---|---|---|
| Apr. 4, 1996 | [JP] | Japan | 8-108527 |
| Mar. 28, 1997 | [JP] | Japan | 9-077478 |

[51] Int. Cl.[6] ..... G03G 15/30; G03G 15/02

[52] U.S. Cl. ..... 399/149; 399/111; 399/175

[58] Field of Search ..... 399/149, 150, 399/174, 175, 176, 168, 111

[56] References Cited

U.S. PATENT DOCUMENTS

| | | | |
|---|---|---|---|
| 5,323,215 | 6/1994 | Ohtaka et al. | 399/150 X |
| 5,563,691 | 10/1996 | Hayakawa et al. | 399/149 |
| 5,652,647 | 7/1997 | Yashiro et al. | 399/111 |
| 5,701,559 | 12/1997 | Ootaka et al. | 399/149 |
| 5,715,499 | 2/1998 | Yamazaki et al. | 399/174 X |
| 5,724,632 | 3/1998 | Arahira et al. | 399/174 |
| 5,751,405 | 5/1998 | Aita et al. | 399/150 |

FOREIGN PATENT DOCUMENTS

| | | |
|---|---|---|
| 0575159 | 12/1993 | European Pat. Off. . |
| 0649073 | 4/1995 | European Pat. Off. . |
| 0696764 | 2/1996 | European Pat. Off. . |
| 696764 | 2/1996 | European Pat. Off. . |
| 0709746 | 5/1996 | European Pat. Off. . |
| 0713161 | 5/1996 | European Pat. Off. . |
| 0763786 | 3/1997 | European Pat. Off. . |
| 63-241587 | 10/1988 | Japan . |
| 1-118878 | 5/1989 | Japan . |
| 4-371975 | 12/1992 | Japan . |
| 4-371976 | 12/1992 | Japan . |
| 4-371977 | 12/1992 | Japan . |
| 5-6086 | 1/1993 | Japan . |
| 6-3921 | 1/1994 | Japan . |
| 6-161211 | 6/1994 | Japan . |
| 6-348107 | 12/1994 | Japan . |

*Primary Examiner*—S. Lee

*Attorney, Agent, or Firm*—Fitzpatrick, Cella, Harper & Scinto

[57] ABSTRACT

An image forming apparatus includes a movable image bearing member; an electrostatic image forming device for forming an electrostatic image on the image bearing member, the electrostatic image forming device including a charging member, contactable to the image bearing member, for charging the image bearing member; developing device for developing the electrostatic image with toner to form a toner image on the image bearing member; a transfer device for transferring the toner image onto the transfer material from the image bearing member, wherein the developing device is capable of cleaning the image bearing member to remove residual toner from the image bearing member, without provision of cleaning device for removing the residual toner from the image bearing member at a position upstream of the charging member and downstream of the transfer device with respect to a moving direction of the image bearing member; and a charge application device, provided upstream of the charging member and downstream of the transfer device with respect to the movement direction, for charging the residual toner on the image bearing member to a polarity opposite from charging polarity of the charging member.

13 Claims, 3 Drawing Sheets

CLEANERLESS IMAGE FORMING APPARATUS

FIELD OF THE INVENTION AND RELATED ART

The present invention relates to an image forming apparatus comprising a charging member which can be placed in contact with an image bearing member to charge the image bearing member.

In the past, generally, a corona type charging device has been employed as means or a device for charging an image bearing member, such as an electrophotographic photosensitive member or an electrostatically recordable dielectric member, of an image forming apparatus, for example, an electrophotographic apparatus or an electrostatic recording apparatus, more specifically, a copying machine, a printer, a facsimile or the like. In charging an image bearing member using a corona type charging device, the actual charging section of the corona type charging device is placed close to, but not in contact with, the surface of the image bearing member as a member to be charged, and the surface of the image bearing member is charged to a predetermined polarity and a predetermined voltage level by a corona shower discharged from the corona type charging device as high voltage is applied to the corona type charging device.

In recent years, a contact type charging apparatus has been put to practical use in place of a corona type charging device. In the case of a contact type charging apparatus, an electrically conductive charging member (contact type charging member) is placed in contact with an object to be charged, and the surface of the object to be charged is charged by applying voltage to the contact type charging member. In comparison to a corona type charging device, a contact type charging apparatus enjoys many advantages; for example, it produces a smaller amount of ozone, and consumes a smaller amount of electricity.

Among various contact type charging system, a roller type charging system employing an electrically conductive roller as the contact type charging member is most stable in terms of charging performance, and also, the amount of the ozone it produces is approximately one thousandth of the amount of the ozone a typical corona charging device produces, which is very desirable in terms of environmental concerns in a business office. As a result, lately, usage of a roller type charging system has become widespread.

In the case of a roller type charging system, an object to be charged is charged by applying voltage to an electrically conductive elastic roller (charging roller) placed, with a predetermined pressure, in contact with the object to be charged.

Japanese Laid-Open Patent Application No. 3,921/1994 discloses a new contact type charging system, "direct charge injection system." According to this system, charge is directly injected into an object to be charged (photosensitive member).

In the case of this new contact type charging system, an object to be charged is to have a charge injection layer as a surface layer, and the object is charged by injecting charge into the electrically conductive particles in the charge injection layer. Since this system does not depend on electrical discharge, the voltage necessary to charge an object has only to be the same as a desired surface potential to which the object is to be charged, and in addition, its ozone generation is excellent, amounting to only one tenth compared to a typical conventional roller type charging system.

As for the contact type charging member usable with this contact type charging system, a fiber brush type charging member, a magnetic brush type charging member composed of magnetic particles, and the like, are more suitable than others.

A fiber brush type charging member comprises an electrically conductive bristle portion with adjusted resistance. This bristle portion is placed in contact with the surface of an object to be charged, and voltage is applied to the bristle portion through the support portion of the bristle portion (hereinafter, fur bristle).

A magnetic brush type charging member comprises a magnetic bristle portion formed by magnetically confining resistance adjusted magnetic particles. The magnetic bristle portion is placed in contact with the surface of an object to be charged, and voltage is applied to the magnetic bristle portion through the supporting member of the magnetic bristle portion (hereinafter, magnetic brush).

In the case of a transfer type image forming apparatus, a toner image is formed on an image bearing member through an image forming process, inclusive of a process for charging the image bearing member, and the toner image formed on the image bearing member is transferred onto a recording medium. The image bearing member is repeatedly used for image formation. In order to reduce the apparatus size and to simplify the apparatus structure, and also because of environmental concerns, a new type of image forming apparatus has been proposed. In the case of this so-called cleanerless image forming apparatus, a cleaning apparatus, as dedicated means for removing the toner (residual toner) remaining on the image bearing member after the image formed on the image bearing member is transferred onto the recording medium, is eliminated, and the residual toner is recovered by a developing apparatus and recycled.

However, the so-called cleanerless image forming apparatus of a conventional type suffered from ghost images; images from the preceding image formation cycles appeared in the images of the following image formation cycles. This ghost phenomenon occurs because the surface of the image bearing member is charged while the residual toner is still there, and therefore, the image bearing member is not properly charged. More specifically, areas with residual toner and areas without residual toner are differently charged, creating nonuniformity in surface potential distribution. When the following image forming cycles, inclusive of the electrostatic latent image formation process as well as the developing process, are carried out under such a condition, the images from the preceding image formation cycles are visualized in a superposing manner together with the images of the following image formation cycles, looking like ghosts.

When a contact type charge injection system is employed as a part of the means for forming an electrostatic latent image on the image bearing member of a cleanerless image forming apparatus, image quality is liable to be affected by the transfer process. More specifically, the level of the toner charge, or the resistance value of a transfer sheet, which generally are very sensitive to ambient humidity, are essential parameters in a transfer process. Therefore, it is rather difficult to maintain transfer efficiency at the optimum level. Further, the characteristics of the residual toner charge are instable since they vary in response to these parameters; the range of the charge level of the residual toner particles becomes very wide, frequently crossing the line between the positive polarity side to the negative polarity side. This is mainly due to the electrical discharge which locally occurs when a transfer sheet is peeled away from an image bearing member.

As transfer efficiency deteriorates, the amount of the residual toner increases, and as a result, a substantial amount of the residual toner is carried to a point at which injection charge occurs, that is, the contact portion between a contact type charging member and an image bearing member, preventing the surface of the image bearing member from being efficiently charged; the surface area covered by the residual toner is prevented from being efficiently charged. As a result, the image bearing member fails to be properly charged.

As for means for preventing ghost images, Japanese Laid-Open Patent Application Nos. 371,975–371,977/1992 disclose a charging apparatus in which two fur brushes are employed to separate the two fur brush functions, that is, the stirring function and the charging function, which previously were carried out by a single fur brush. Japanese Laid-Open Patent Application 161,211/1994 discloses another charging apparatus in which two magnetic brushes are employed to separate the two magnetic brush functions, that is, the magnetic carrier recovering function and the charging function, which previously were performed by a single magnetic brush. Further, Japanese Laid-Open Patent Application No. 348,107/1994 discloses another charging apparatus in which a magnetic charging brush is disposed on the upstream side of the image bearing member relative to the direction in which the surface of an image bearing member moves, and a fur brush for recovering the magnetic carrier which accidentally leaks from the magnetic brush is disposed on the downstream side.

However, the following became evident through actual tests. In the case of a charging apparatus comprising only a single fur brush as Japanese Laid-Open Patent Application Nos. 371,975–371,977/1994 disclose, a nonuniform uneven charge pattern which looks like a sweeping mark is created, which was fatal to image quality. In the case of a charging apparatus employing only a magnetic brush as Japanese Laid-Open Patent Application No. 161,211/1994 discloses, it was difficult to loosen the residual toner firmly adhering to an image bearing member, and also, the loosened and stripped toner could not be prevented from accumulating in the magnetic brush, and as a result, the resistance value of the magnetic brush increased, which caused deterioration in charging performance. In the case of a charging apparatus such as the one disclosed in Japanese Laid-Open Patent Application No. 348,107/1994, the nonuniform charge pattern like a sweeping mark was caused by the fur brush since the fur brush having coarse bristles was disposed on the most downstream side.

Further, simply disposing a toner loosening brush, or a memory erasing brush, between the transfer point and the charging point as Japanese Laid-Open Patent Application No. 241,587/1988 or 118,878/1989 discloses, is not sufficient to eliminate the ghost.

Japanese Laid-Open Patent Application No. 6,086/1993 discloses a charging apparatus in which a loosening-charging member of a contact type is disposed on both the upstream and downstream sides of an image bearing member, and an AC voltage and a negative DC voltage are applied in a superposing manner to both of the contact type charging apparatuses. However, since the residual toner sometimes contains both negatively charged particles and positively charged particles as described above, it is difficult to loosen both the negatively charged toner particles and the positively charged toner particles. Therefore, even in the case of this charging apparatus, it was difficult to completely eliminate the ghost.

SUMMARY OF THE INVENTION

The primary object of the present invention is to prevent the appearance of a ghost image in the images formed by an image forming apparatus in which developing means removes the residual toner from the image bearing member after image transfer.

Another object of the present invention is to provide an image forming apparatus whose charging member does not unevenly charge the image bearing member even when there is the residual toner on the image bearing member after image transfer.

Another object of the present invention is to provide an image forming apparatus which is capable of desirably charging the image bearing member regardless of the polarities of the residual toner particles which are present on the image bearing member after image transfer.

These and other objects, features and advantages of the present invention will become more apparent upon a consideration of the following description of the preferred embodiments of the present invention, taken in conjunction with the accompanying drawings.

DETAILED DESCRIPTION OF THE PREFERRED EMBODIMENTS

Figure 1:
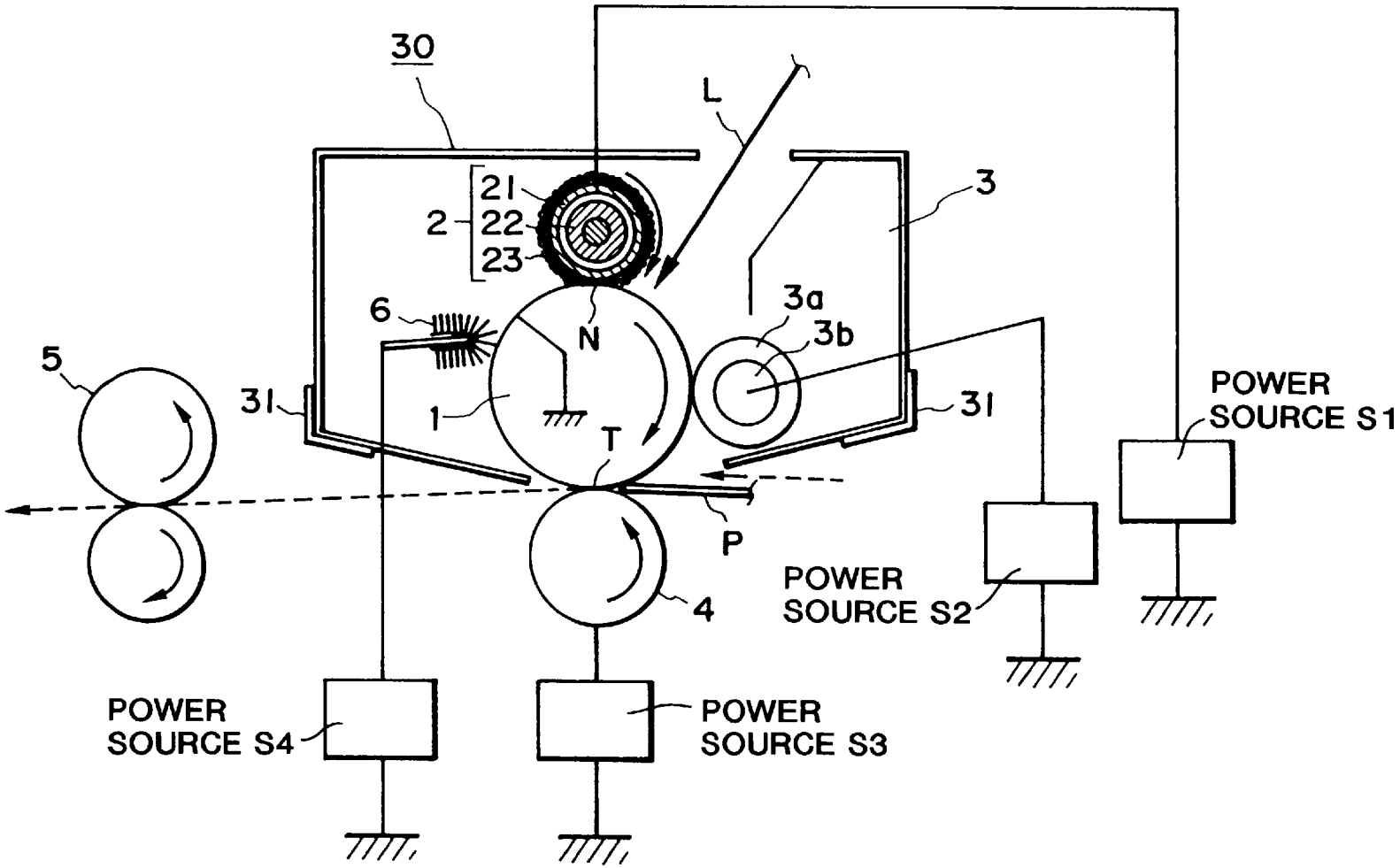
FIG. 1 is a schematic section of an image forming apparatus in an embodiment of the present invention.

Embodiments (1) Image Forming Apparatus (FIG. 1)

FIG. 1 is a schematic section of the structure of an image forming apparatus in accordance with the present invention.

The image forming apparatus in this embodiment is a cleanerless laser beam printer which employs a transfer type electrophotographic process, a contact type charge injection system comprising a plurality of contact type charging members, and a removably installable process cartridge.

A reference numeral 1 designates a rotational drum type electrophotographic photosensitive member as an image bearing member (object to be charged). It is an organic photosensitive member (organic photoconductive member) having a charging injection surface layer. It has a diameter of 30 mm and is rotatively driven in the clockwise direction indicated by an arrow mark at a process speed (peripheral velocity) of 150 mm/sec. The laminar structure of this photosensitive member 1 will be described in detail later in FIG. (2).

A reference numeral 2 designates a rotational sleeve type magnetic brush as a contact type charging member. It is placed in contact with the photosensitive member 1. Source S1 designates an electric power source for applying charge bias to the magnetic brush 2.

In this embodiment, a DC voltage of −700 v as a charge bias is applied to the electrode-sleeve of the magnetic brush 2 from the charge bias application power source S1, whereby the peripheral surface of the rotational photosensitive member 1 is uniformly charged to approximately −700 V; charge is directly injected by contact. The details of the magnetic brush 2 will be described later in Item (4).

The uniformly charged surface of the rotational photosensitive member 1 is exposed to a scanning laser beam L emitted, being modulated in intensity in response to sequential electric digital signals reflecting the image data of a target image, from an unillustrated laser beam scanner comprising, in the case of this embodiment, a laser diode, a polygon mirror, and the like. As a result, an electrostatic latent image corresponding to the image data from the target image is formed on the peripheral surface of the rotational photosensitive member 1.

Tho electrostatic latent image is developed as a toner image by a developing apparatus 3. The developing apparatus 3 is a reversal type developing apparatus which employs single component magnetic toner (negative toner). An alphanumeric reference 3*a* designates a nonmagnetic developing sleeve having a diameter of 16 mm. It contains a magnet 3*b*. The aforementioned negative toner is coated on the developing sleeve 3*a*. The nonmagnetic developing sleeve 3*a* is rotated at the same peripheral velocity as the photosensitive member 1, with the distance between itself and the photosensitive member 1 being fixed at 300 $\mu$m, and developing bias is applied to the sleeve 3*a* from a developing bias power source S2. The developing bias in this embodiment is a voltage composed by superposing a DC voltage of −500 V and an AC voltage having a frequency of 1,800 Hz, a peak-to-peak voltage of 1,600 V, and a rectangular waveform. The electrostatic latent image on the photosensitive member 1 is developed by the jumping developing method which is carried out between the sleeve 3*a* and the photosensitive member 1; the negative toner adheres to the photosensitive member 1, on the areas corresponding to brighter exposure, visualizing thereby the electrostatic latent image as a toner image.

Meanwhile, a transfer material P as a material (recording medium) on which an image is recorded, is fed from an unillustrated sheet feeder portion, and is introduced, with predetermined timing, into a pressure nip (transfer portion) T formed by the photosensitive member 1 and a medium resistance transfer roller 4 as contact type transferring means placed in contact with the photosensitive drum 1 with a predetermined contact pressure.

To the transfer roller 4, a predetermined transferring bias voltage is applied from a transfer bias application power source S3. While the transfer material P introduced into the transfer portion T is conveyed, being pinched by the photosensitive member 1 and the transferring roller 4, the toner image formed and held on the peripheral surface of the photosensitive drum 1 is transferred, continuously from one end to the other, onto the front (top) surface of the transfer material P by electrostatic force and compressive force. In this embodiment, the resistance value of the transfer roller 4 is $5\times10^8$ Ω, and the voltage applied for the image transfer is a DC voltage of +2,000 V.

The transfer material P on which the toner image has been transferred is separated from the surface of the photosensitive drum 1, and is introduced into a fixing apparatus 5 employing a thermal fixing system or the like, in which the toner image is fixed to the transfer material P. Thereafter, the transfer material P is discharged as a print or copy from the image forming apparatus.

As for the forces which act on the toner on the photosensitive member 1, there is the adhesive force of the toner besides the transferring electric field generated by the transfer bias. Therefore, it seldom occurs that the toner particles forming the image on the photosensitive member 1 are transferred onto the transfer material side by 100%; a certain portion of the toner particles remain as post-transfer residual toner on the surface of the photosensitive member 1. Conventionally, an image forming apparatus is provided with a cleaning apparatus, which is disposed after the transferring portion T, and this residual toner is removed from the photosensitive member surface by the cleaning apparatus to clean the surface of the photosensitive member so that the photosensitive member 1 can be repeatedly used for image formation.

However, in a cleanerless image forming apparatus such as the image forming apparatus in this embodiment, no cleaning apparatus is disposed between the transfer portion T and the charging point of the charging member 2, with the former being on the upstream side of the elastic member relative to the rotational direction of the photosensitive member 1 and the latter being on the downstream side. In such an image forming apparatus, the toner remaining on the photosensitive member 1 after the transfer material P is separated from the photosensitive member 1 is carried to the actual charging portion of the charging member 2 as the photosensitive member 1 is rotated. In other words, the peripheral surface of the photosensitive member, which is partially covered with the post-transfer residual toner, is charged for the following image formation by the charging member, and is exposed for image formation, whereby an electrostatic latent image is formed on the surface of the photosensitive member 1 which the residual toner is partially covering. Thereafter, as the photosensitive member 1 is rotated, the residual toner on the photosensitive member 1 reaches the developing portion of the developing apparatus 3. In the developing apparatus 3, a developing bias (direct current) whose voltage level falls between the potential level corresponding to the darkest portions of the electrostatic latent image, and the potential level corresponding to the bright portions of the electrostatic latent image is applied to the developing sleeve of the developing apparatus 3. The residual toner is transferred (recovered) onto the developing sleeve from the surface areas of the photosensitive member, correspondent to the dark portion of the electrostatic latent image, due to the difference (fog removing potential difference $V_{back}$) between the potential levels of the dark portions of the electrostatic latent image, and the level of the DC voltage applied to the developing sleeve. At the same time as the residual toner is transferred (recovered) onto the developing sleeve, the toner on the developing sleeve is transferred onto the surface areas of the photosensitive member 1 corresponding to the bright portions of the electrostatic latent image; the electrostatic latent image is developed by the toner. In other words, the residual toner is cleaned by the developing apparatus 3 at the same time as the latent image is developed, and is recycled as the developer for the following image forming cycle. A cleanerless image forming apparatus such as the one described in this embodiment can be reduced in size and simplified in structure, obviously because of the absence of a cleaning apparatus. Also, it does not create waste toner, which makes it desirable from the ecological standpoint.

In this embodiment, a fur brush 6, that is, an elastic member as charging means, is disposed between the transfer portion T and the charging point of the charging member 2, with the former being on the upstream side of the elastic member relative to the rotational direction of the photosensitive member 1 and the latter being on the downstream side. This fur brush 6 comprises a nonrotational electrically conductive support member and an electrically conductive fiber bristle portion (resistance: $10^3$–$10^4$ Ω/cm; length: 3 mm; cross-sectional dimension: 30 $\mu$m/bristle; density: 100,000 bristles/inch$^2$). To the fur brush 6, a predetermined DC bias (voltage having the polarity opposite to the charge polarity of the charging member 2) is applied by an electric power source S4.

The toner remaining on the photosensitive member 1 after the separation of the transfer material from the photosensitive member 1 is carried to the developing apparatus 3, past the fur brush 6, the magnetic brush 2, and the exposing portion.

As for the charge polarity of the residual toner, the charge polarity of each toner particle might be different from those of others depending on its pre-transfer triboelectical charge level which is dependent on ambient temperature and humidity, and also depending on the resistance of the transfer material. In other words, some residual toner particles may have the positive polarity, whereas others may have the negative polarity. Therefore, after the toner image formed on the photosensitive member 1 is transferred onto the transfer material P, the toner particles remaining on the photosensitive member 1 are uniformly charged to the polarity (positive polarity) opposite to the charge polarity of the charging member 2, by the fur brush 6 as the elastic charging member. The residual toner particles are temporarily arrested by the fur brush 6, so that the residual toner particles having negative triboelectrical charge before being subject to the charging by the fur brush 6 can be easily charged to the polarity opposite to the charge polarity of the charging member 2. The residual toner particles having the positive polarity before being subjected to the charging by the fur brush 6 maintain the positive polarity as they pass the fur brush 6. Thus, the residual toner particles are uniformly charged to the positive polarity as they pass the fur brush 6. Then, as the residual toner particles now having the positive polarity reach the charging position of the charging member 2, they are transferred (recovered) from the photosensitive drum 1 onto the magnetic brush by electrostatic attraction, and mixed into the magnetic particles. After being mixed into the magnetic particles, the residual toner particles are charged to the negative polarity within the magnetic brush, and then, uniformly discharged onto the photosensitive member 1 without leaving a trace of the preceding image pattern. The surface of the photosensitive member 1 is uniformly charged by the magnetic brush concurrently as the residual toner is transferred from the photosensitive member 1 onto the magnetic brush and discharged back onto the photosensitive member 1. The reason why the residual toner particles mixed into the magnetic brush are discharged back onto the photosensitive drum 1 is as follows. As the amount of the residual toner mixed into the magnetic brush increases, the electrical resistance of the magnetic brush is reduced, which in turn increases the difference in electrical potential between the photosensitive drum 1 and the sleeve of the magnetic brush portion, and as a result, a toner particle discharging electric field is generated. Therefore, as the amount of the toner mixed into the magnetic brush increases, the amount of the toner discharged onto the photosensitive member also increases.

As described above, since the residual toner is temporarily transferred onto the magnetic brush type charging member, the photosensitive member can be uniformly charged so that the ghost does not appear. Further, the fur brush as the charging means plays a role in making the residual toner polarity, which is not positive for all the residual toner particles after toner image transfer, positive for all the residual toner particles, that is, in making all the residual toner particles have the polarity opposite to the charge polarity of the charging member, so that the residual toner particles can be easily transferred onto the charging member.

The image forming apparatus in this embodiment is a cartridge type image forming apparatus which employs a process cartridge removably installable in the main assembly of the apparatus. The cartridge usable with the image formation apparatus of this embodiment comprises four processing devices: the photosensitive member 1, magnetic brush 2 (charging member), fur brush 6, and developing apparatus 3, which are integrally disposed within a cartridge shell 30. A reference numeral 31 designates a member which supports and guides a process cartridge when the cartridge is installed or removed. The combination of the processing devices disposed in the process cartridge shell 30 A is not limited to the one described above; any combination will suffice as long as it includes the photosensitive member 1 and at least one of three processing devices: charging member 2, fur brush 6, and developing apparatus 3.

Figure 2:
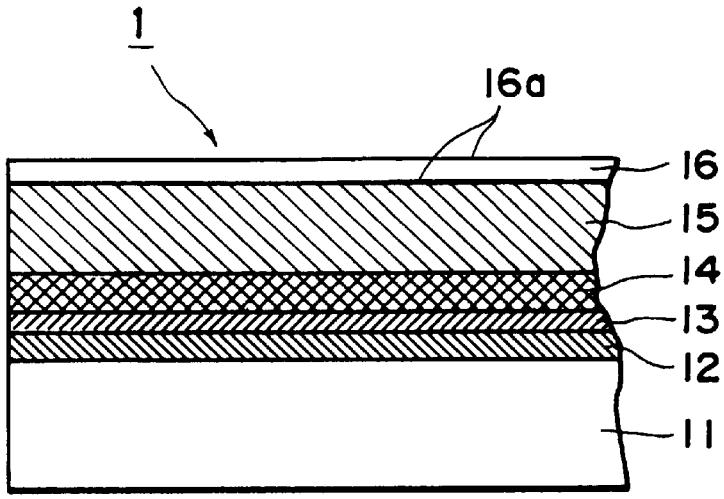
FIG. 2 is a schematic section of the laminar structure of a photosensitive member in accordance with the present invention.

(1) Photosensitive Member 1 (FIG. 2)

The photosensitive member 1, as an image bearing member, in this embodiment is a negatively chargeable photosensitive member of an OPC type. As is evident from FIG. 2 which schematically depicts the laminar structure of the photosensitive member 1, the photosensitive member 1 comprises a base member 11, which is an aluminum drum, and five (first to fifth) functional layers 12–16 laminated on the peripheral surface of the base member 11 in this order from the bottom, the surface layer being a charge injection layer 16.

The first layer 12 is an undercoat layer, which is an approximately 20 $\mu$m thick electrically conductive layer. It is placed to cover the surface defects or the like of the drum-like aluminum base member 11, and also to prevent the occurrence of the moire caused by the reflection of an exposure laser beam.

The second layer 13 is a layer for preventing the injection of positive charge; it plays a role in preventing the positive charge injected from the drum-like aluminum base member, from canceling the negative charge given to the surface of the photosensitive member. It is an approximately 1 $\mu$m thick layer composed of Amylan resin and methoxymethyl Nylon, and its resistance is adjusted to approximately $10^6$ Ω/cm.

The third layer 14 is a charge generation layer, which is an approximately 0.3 $\mu$m thick resin layer in which diazo group pigment is dispersed. It generates charge couples comprising positive charge and negative charge as it is exposed to a laser light.

The fourth layer 15 is a charge transfer layer, which is composed of polycarbonate resin in which hydrazone is dispersed; it is a P-type semiconductor. Therefore, the negative charge given to the photosensitive member surface cannot transfer through this layer, whereas the positive charge generated in the charge generation layer is allowed to transfer to the photosensitive member surface.

The fifth layer 16 is a charge injection layer, which is composed of photo-hardening acrylic resin as electrically insulative binder, and micro-particles of $SnO_2$ as electrically conductive particles (electrically conductive filler) 16*a* which are dispersed in the acrylic resin. It is laminated by painting.

More specifically, the micro-particle of $SnO_2$ is approximately 0.03 $\mu$m in particle diameter, and is doped with antimony to reduce its electrical resistance. It is dispersed in the binder resin by 70% in weight. The thus prepared solution is coated by dipping to a thickness of approximately 2 $\mu$m to form the charge injection layer.

With the provision of the above described laminar structure, the surface resistance of the photosensitive member is reduced to as low as $1\times10^{13}$ Ω/cm, in comparison to 1×1015 Ω/cm which is the surface resistance of a photosensitive member having only the charge transfer layer 15. The volumetric resistivity of the charge injection layer is desired to be in a range of $1\times10^{10}$–$1\times10^{14}$ Ω/cm. It is measured using the following method. A sample of the charge injection layer is formed in the sheet form, and its volumetric resistivity is measured by a High Resistance Meter 4329A (Yokogawa-Hewlette-Packard Co., Ltd.) connected to Resistivity Cell 16008A, while applying a voltage of 100 V.

Figure 3:
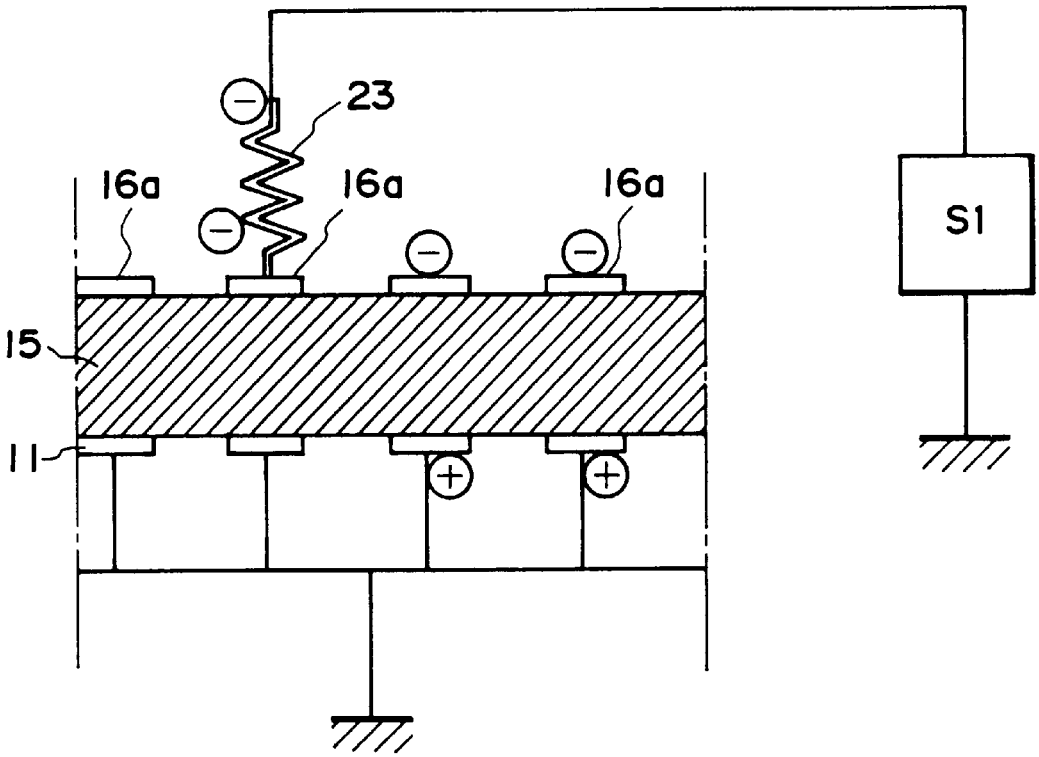
FIG. 3 is a schematic drawing which depicts a contact type charge injection principle.

(3) Principle of Contact Type Charge Injection (FIG. 3)

In the contact type charge injection, charge is injected by a contact type charging member having a medium range resistance, into the surface layer of an object to be charged, which also has a medium range resistance. In this embodiment, charge is not injected into the traps in the surface layer material of the photosensitive member as the object to be charged, but is given to the electrically conductive particles 16*a* in the charge injection layer 16.

More specifically, referring to the schematic equivalent circuit in FIG. 3, the contact type charge injection in this embodiment is based on a theory that a microscopic condenser constituted of the charge transfer layer 15 as a dielectric member, the drum-like aluminum base 11 as one of the two electrodes, and the electrically conductive particle ($SnO_2$) 16*a*, as the other electrode, within the charge injection layer 16, is charged by the contact type charging member 2.

According to this theory, each of the electrically conductive particles 16 is electrically independent from the others, constituting a sort of a microscopic floating electrode. Therefore, even though the photosensitive member surface appears to be uniformly charged in macroscopic terms, actually, the photosensitive drum surface is covered with an infinite number of charged microscopic, electrically conductive particles 16. Thus, the electrostatic latent image formed as the photosensitive member surface is exposed to an image forming exposure beam L can be maintained since each of the electrically conductive particles 16 is electrically independent from the others.

Figure 4:
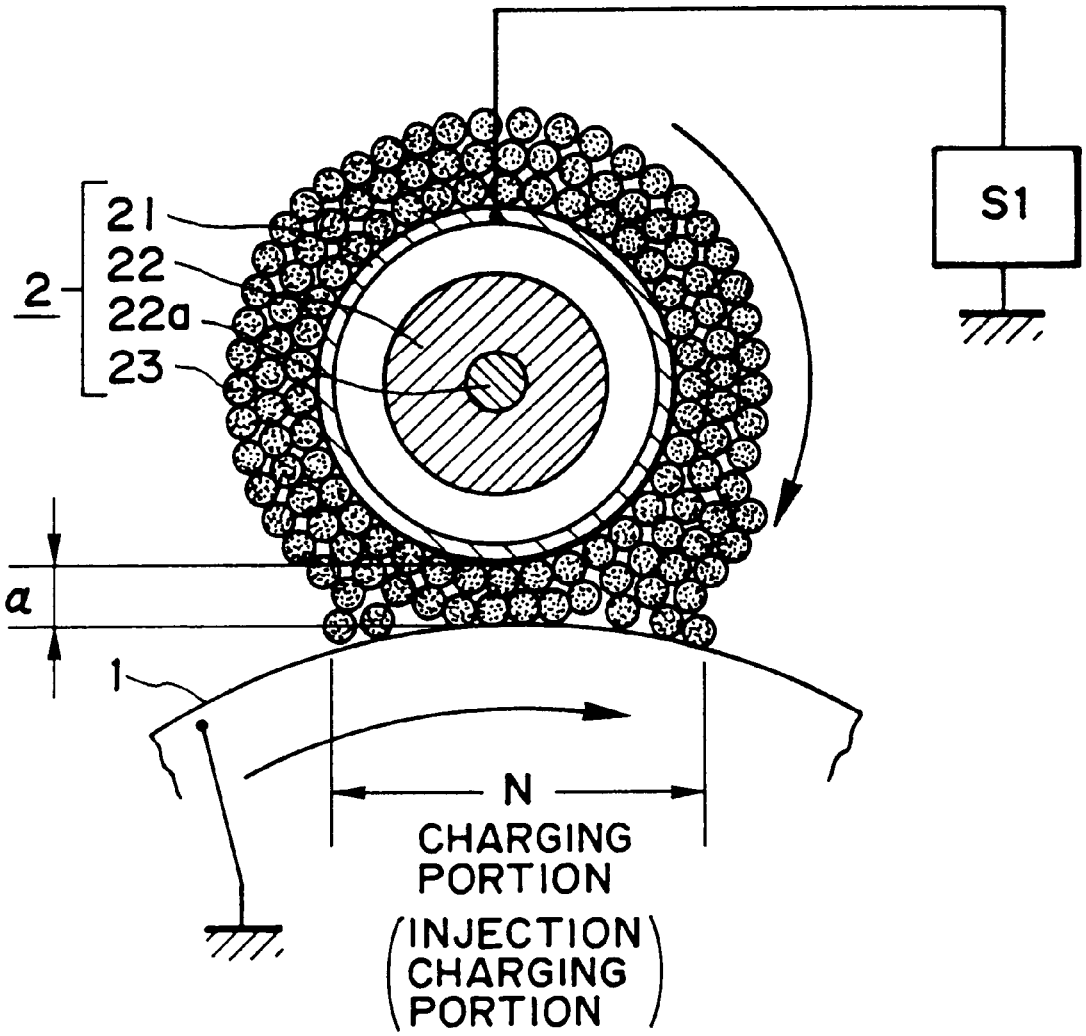
FIG. 4 is a schematic section of a magnetic brush type charging member having a rotational sleeve.

(4) Magnetic Brush 2 (FIG. 4)

FIG. 4 is a cross-section of the rotational sleeve type magnetic brush 2 in this embodiment.

This magnetic brush 2 comprises: a metallic core 22*a*; a magnetic roller 22 as a magnetic force generating member, which is coaxially and fixedly fitted around the metallic core 22*a*; a nonmagnetic sleeve 21 as an electrode (hereinafter, electrode-sleeve 21), which is coaxially and rotatively fitted around the magnetic roller 22; and a magnetic bristle portion 23 composed of magnetic particles held on the peripheral surface of the nonmagnetic electrode-sleeve 21 by the magnetic force from the magnetic roller 22 contained in the nonmagnetic electrode-sleeve 21.

This magnetic brush 2 is disposed substantially in parallel to the photosensitive member 1, so that the magnetic bristle portion 23 is placed in contact with the surface of the photosensitive member 1 as the object to be charged, to form a charging station N (charge injecting portion, or charging nip) having a predetermined width. The magnetic roller 22 is nonrotationally supported, and the electrode-sleeve 21 is rotatively driven so that its rotational direction in the charging station N becomes opposite to the rotational direction of the photosensitive member 1. As the electrode-sleeve 21 is rotated, the magnetic particles in the magnetic bristle portion 23 are also moved in the same direction, rubbing the surface of the photosensitive drum 1. Since a predetermined charging bias is applied to the electrode-sleeve 21 from the charging bias power source S1, the surface of the photosensitive drum 1 is uniformly charged to a predetermined polarity and a predetermined potential level; the surface of the photosensitive member 1 is charged by the contact type charging system.

The gap α, in the charging station N, between the photosensitive member 1 and the sleeve 21 as the electrode, is set to be less than the thickness of the magnetic bristle portion 23 formed on the peripheral surface of the electrode-sleeve 21; therefore, as the electrode-sleeve 21 is rotated, the magnetic particles in the magnetic bristle portion are carried through the charging station N in a manner of being packed into the gap α. With this arrangement, the magnetic particles in the magnetic bristle portion 23 make contact with the photosensitive member 1 in higher density; it is assured that the magnetic brush 22 makes desirable contact with the photosensitive member 1.

Also, with this arrangement, the friction between the magnetic particles in the magnetic bristle portion 23 and the surface of the photosensitive drum 1 increases in the charging station N, which reduces efficiency in conveying the magnetic particles through the charging station N. In order to prevent this reduction in magnetic particle conveyance efficiency, the peripheral surface of the electrode-sleeve 21 as the electrode is roughened by sand-blasting or the like, to counter the reduction.

At the peripheral surface of the electrode-sleeve 21, the density of the magnetic flux from the magnetic roller 23 is $800\times10^{-4}$ T (tesla).

The magnetic bristle portion 23 is formed by coating magnetic particles on the peripheral surface of the electrode-sleeve 21 as the electrode to a thickness of 1 mm, and is placed in contact with the photosensitive member 1, forming the charging station N having a width of approximately 5 mm. The amount of the magnetic particles confined in the magnetic bristle portion 23 is approximately 10 g, and the gap α between the electrode-sleeve 21 and the photosensitive member 1, in the charging station N, is 500 μm.

In the charging station N, the electrode-sleeve 21 is rotatively driven in the direction indicated by an arrow mark, that is, the direction opposite to the rotational direction of the photosensitive member 1, and as the electrode-sleeve 21 is rotated, the magnetic bristle portion 23 is also rotated, rubbing against the surface of the photosensitive member 1.

The peripheral velocity ratio between the magnetic brush and the photosensitive member 1 is defined by the following equation:

Peripheral Velocity Ratio (%)={(magnetic brush's peripheral velocity−photosensitive member's peripheral velocity)/photosensitive member's peripheral velocity}×100

* when rotated in the counter direction, the magnetic brush's peripheral velocity has a negative value.

A peripheral velocity ratio of −100% means that the magnetic brush is stationary, and in this condition, a ghost corresponding to the magnetic brush's foot print on the surface of the photosensitive member 1 is liable to appear in the image being created. In a case in which the peripheral surfaces of the magnetic brush and the photosensitive member are moving in the same direction in the charging station N, an attempt to obtain the same peripheral velocity ratio as that obtained when they are moving in the opposite directions requires increase in the magnetic brush rotation. When the magnetic brush, rotating at a slow speed, makes contact with the photosensitive member while their peripheral surfaces are moving in the same direction, the magnetic particles in the magnetic bristle portion are liable to adhere to the photosensitive member 1. Therefore, the peripheral velocity ratio is desired to be no more than −100%. In this embodiment, it was set at −150%.

As for the magnetic particles which form the magnetic bristle portion 23, they are formed in the following manner.

(1) Resin and powder of magnetic material such as magnetite are kneaded together, and the mixture is molded into particles; thus obtained particles may be mixed with electrically conductive particles such as carbon particles to adjust electrical resistance.

(2) Magnetite or ferrite is sintered; the obtained particles may be reduced or oxidized to adjust their electrical resistance.

(3) The above magnetic particles are coated with coating material (phenol resin in which carbon is dispersed, or the like) whose electrical resistance is adjusted; or plated with metal such as Ni to adjust their electrical resistance to a proper value.

As for the resistance values of these magnetic particles, when they are too high, charge cannot be uniformly injected into the photosensitive member, effecting a foggy image caused by charge failure on a microscopic scale. On the contrary, when they are too low, current is concentrated to pin holes, if there are any at the photosensitive member surface, causing charging voltage to drop, and therefore, preventing the photosensitive member surface from being charged. Therefore, it is desirable that the electrical resistance value of the magnetic particle is in a range of $1\times10^4$–$1\times10^7$ Ω.

The resistance value of the magnetic particle was measured while applying a voltage of 1–1000 V to two grams of the magnetic particles compacted in a metal cell (bottom size: 228 $mm^2$) to which voltage can be applied.

As for the particle diameter of the magnetic particle, when it is too small, the coercive force of the magnetic particle becomes too small, and therefore, the magnetic particles adhere to the photosensitive member as the object to be charged. When it is too large, the contact area between the magnetic particle and the photosensitive member becomes smaller, which leads to charge failure. Therefore, it is desirable that the average particle diameter of the magnetic particles is in a range of 5–100 μm.

The average particle diameter of the magnetic particles is represented by the maximum chord length in the horizontal direction. It is measured using a microscope; the diameters of no less than 300 randomly selected magnetic particles are actually measured to obtain their mathematical average.

As for the magnetic characteristics of the magnetic particle, in order to prevent the magnetic particles from adhering to the photosensitive member, the coercive force of the magnetic particle is desired to be high; it is desirable that the saturation magnetization of the magnetic particle is no less than 50 $A\cdot m^2/kg$.

For the measurement of the magnetic characteristics of the magnetic particle, an automatic DC current magnetization B-H recording apparatus BHH-50 (Riken Electronics Co., Ltd.) may be used. In measuring, approximately two grams of magnetic particles are placed in a cylindrical container measuring 6.5 mm in internal diameter, and 10.0 mm in height, and are compacted so that they do not shift within the container. Their saturation magnetization is obtained from their B-H curve.

As the photosensitive member 1 as an object to be charged is rubbed by the magnetic bristle portion 23, the photosensitive member 1 is gradually damaged. In order to minimize this damage to the photosensitive member 1, it is desirable that the magnetic particles forming the magnetic bristle portion 23 are rounded.

As for the specifications of the magnetic particles actually used in this embodiment, the average particle diameter was 30 μm; the electrical resistance value was $1\times10^6$ Ω; and the saturation magnetization was 58 ($A\cdot m^2/kg$).

(5) Bias Applied to Fur Brush

A test is conducted to examine the effects of the bias applied to the fur brush 6 from the power source S4. The results are given in Table 1.

As is evident from the table, applying to the fur brush 6 a voltage having the polarity (positive) opposite to the polarity (negative in this embodiment) of the bias applied to the magnetic brush 22 is effective.

It also becomes evident, however, that applying a very high voltage (several kilovolts) is not so desirable. The cleaning setup in this embodiment is different from the conventional cleaning setup employing a fur brush in that after being subjected to the charging process in the fur brush portion, the residual toner is carried past the fur brush 6. In this type of setup, it does not occur that the fur brush 6 is increasingly soiled and loses its cleaning performance. In other words, the present invention is characterized in that the fur brush 6 can withstand long term usage. As for the range of the voltage applied to the fur brush 6, a range of 100 V–2 kV is desirable.

It should be noted here that the same results could be obtained when a sponge member, a rubber blade, or the like was used as the elastic charging member, in place of the fur brush.

As for the voltage to be applied to the fur brush 6, it may be a voltage composed by superposing an AC voltage and a DC voltage (+700 V). However, when an AC voltage is applied, it is more liable that the residual toner adheres to the fur brush 6, and deteriorates the charging performance of the fur brush 6 than when a DC voltage alone is applied. Therefore, it is desirable that the voltage to be applied to the fur brush 6 is a DC voltage alone.

Table 2 shows the results of an endurance test in which a printer having the structure illustrated in FIG. 1 was used to continuously form an image on transfer materials of A size.

The No. 2 type setup was initially effectively to prevent the ghost, but after 1,000 sheets, the ghost could not be prevented any more.

The No. 3 type setup was desirable in terms of the ghost, and it took a much larger number of sheets before the ghost appeared, than the No. 2 type. However, the No. 3 type setup, which used a magnetic brush and a DC voltage, was inferior in charging performance to a setup using an DC voltage, and was weak in terms of soiling resistance. In other words, the No. 3 type setup is suitable for an inexpensive apparatus with a short life.

The No. 4 type setup is the same as the No. 2 setup except for improvement in terms of the ghost.

In the No. 5 type setup, the ghost preventing function was assigned to the fur brush 6. As for the magnetic brush 2, an AC voltage having the minimum Vpp necessary for maintaining the charging performance and the subsequent ghost preventing performance even after the magnetic brush 2 was slightly soiled was applied to the magnetic brush 2 so that an AC fog can be prevented. In other words, the No. 5 setup is suitable for equipment designed for durability.

As is possible to predict from the above results, the setup in accordance with the present invention can produce a remarkable effect, in terms of durability, of such a magnitude that has never been seen before, as long as it does not occur that the magnetic brush 2 or the fur brush 6 becomes so soiled that it loses effectiveness.

In this test, neither the magnetic brush 2 nor the fur brush 6 was cleaned. However, if cost allows, the toner may be periodically brushed off from the toner-soiled fur brush 6, and bias may be aggressively applied to the magnetic brush 2 and the fur brush 6 to clean them. Such an arrangement is thought to epochally improve the service life of the apparatus.

When a voltage (oscillating voltage) composed by superposing an AC voltage and a DC voltage is applied to the magnetic brush type charging member, the magnetic particles which form the magnetic bristle portion move more actively during the charging process than when a DC voltage alone is applied; therefore, in the charge injection portion, the residual toner on the image bearing member is more effectively loosened away, and the image bearing member is more effectively charged. Further, when the voltage composed by superposing an AC voltage and a DC voltage is applied, the charging apparatus displays stable charging performance even under the conditions in which the contact type charging member has deteriorated due to extended usage or the ambience has changed. Therefore, the application of such a voltage is desirable.

However, in charging an image bearing member, in particular, using a charge injection system, increasing the peak-to-peak voltage Vpp of an AC voltage may sometimes cause a fog which is attributable to nonuniform charge. Therefore, in order to prevent this type of fog, the No. 5 type setup is preferable to the No. 4 type setup, and it is desirable that the peak-to-peak voltage Vpp is no more than 900 V.

Miscellaneous Embodiments (1) In the preceding embodiment, the magnetic brush 2 is of a rotational sleeve type, but it may be of a rotational magnetic roller type, in which the magnetic particles are magnetically held on a rotational magnetic roller, directly or through an electrically conductive coated layer; or it may be a nonrotational magnetic brush type member.

It may be also of a type in which the magnetic particles are magnetically confined as a magnetic brush in the bristle portion of a rotational or nonrotational fur brush by the magnetic force generated by a magnetic force generating member.

(2) The fur brush 6 as an elastic charging member may be of a rotational type. Further, the elastic charging member does not need to be in the form of a fur brush; it may be in the form of a rotational or nonrotational member of sponge material, a rubber blade, or the like.

(3) The contact type charging member does not need to have just one elastic charging member 6 or one magnetic brush type charging member 2; it may have one member, or both members in plurality.

(4) In applying an AC bias to the magnetic brush 2, the elastic charging member 6, and/or the developing member 3*a*, the waveform of the AC bias may be any of a sine wave, a rectangular wave, a triangular wave, and the like depending on appropriateness. Further, the AC bias may be a voltage having a rectangular waveform formed by periodically turning on and off a DC power source. In other words, any bias that periodically changes its voltage value may be used as the AC bias.

(5) The image bearing member as an object to be charged does not need to be an electrophotographic photosensitive member; it may be a dielectric member or the like used in electrostatic recording.

In the case of a charging system in which the contact type injection charge is dominant, it is desirable that the object to be charged has a surface layer having a resistance of $10^9$–$10^{14}$ Ω·cm. As for the electrophotographic photosensitive member, it is possible to use a photosensitive member comprising an OPC photosensitive member and a coated surface layer (charge injection layer) dispersively containing particles of electrically conductive material such as $SnO_2$, a photosensitive member comprising a surface layer composed of α-Si (amorphous silicon), or any other photosensitive member chargeable by charge injection.

(6) The image exposing means as means for writing information on the image bearing member surface in an image forming apparatus does not need to be a scanning laser beam based exposing means, such as the one described in the preceding embodiment, that forms a digital latent image; any means capable of forming an electrostatic latent image reflecting image data will suffice; for example, an ordinary analog image exposing means, light emitting mean such as an LED, or a combination of a light emitting element such as a fluorescent lamp and a liquid crystal shutter.

When the image bearing member is an electrostatically recordable dielectric member, an electrostatic latent image reflecting the image data of a target image is written on the uniformly charged surface of the dielectric member through discharging of the selected surface areas of the dielectric member by a discharging needle head, an electron gun or like.

(7) As for the developing apparatus 3, any of those based on various development principles or systems may be employed; obviously, it may be the one based on a normal development system.

(8) The image transferring system is not limited to the roller based transferring system employed in the preceding embodiment; a blade based transferring system or any other contact type charging system for image transfer, or a system based on corona discharge may be used.

(9) The image forming apparatus does not need to be an image forming apparatus which forms only a monochromatic image; it may be an image forming apparatus which employs an intermediary transferring member such as a transfer drum or a transfer belt, and forms a multicolor image, a full-color image, or the like, as well as a monochromatic image, through an superposing multiple transfer process or the like.

While the invention has been described with reference to the structures disclosed herein, it is not confined to the details set forth, and this application is intended to cover such modifications or changes as may come within the purposes of the improvements or the scope of the following claims.

What is claimed is:

1. An image forming apparatus comprising:

a photosensitive member;

a charging member, contactable to said photosensitive member, for charging said photosensitive member;

exposure means for exposing said photosensitive member charged by said charging member to image light so as to form an electrostatic image;

developing means for developing the electrostatic image with toner to form a toner image on said photosensitive member;

transfer means for transferring the toner image onto a transfer material from said photosensitive member, wherein after said transfer means transfers the toner image, said charging member charges said photosensitive member from which at least some residual toner has not been removed; and charge application means for applying an electric charge of a polarity opposite from a charging polarity of said charging member onto a surface of said photosensitive member after the transfer of the toner image by said transfer means and before charging by said charging member so as to permit said charging member to collect the residual toner.

2. An apparatus according to claim 1, wherein said charging member includes magnetic particles in the form of a magnetic brush contactable to said photosensitive member.

3. An apparatus according to claim 2, wherein said charging member is supplied with an AC biased DC voltage.

4. An apparatus according to claim 1, wherein said charge application means includes a charge application means contacted to said photosensitive member.

5. An apparatus according to claim 4, wherein said charge application means is supplied with non-AC-biased DC voltage.

6. An apparatus according to claim 4, wherein said charge application means has an elasticity.

7. An apparatus according to claim 4, wherein said charge application means includes a fibrous brush.

8. An apparatus according to claim 1, wherein said charging member collects the residual toner from said photosensitive member and then returns the residual toner to said photosensitive member.

9. An apparatus according to claim 1, further comprising a process cartridge detachably mountable to a main assembly of said apparatus, wherein said process cartridge contains said photosensitive member and said charging member.

10. An apparatus according to any one of claims 1 to 9, wherein said photosensitive member has a charge injection surface layer, into which electric charge is injected through a portion thereof which is in contact with said charging member.

11. An apparatus according to claim 10, wherein said charge injection surface layer has a volume resistivity of $1\times10^{10}$–$1\times10^{14}$ Ohm·cm.

12. An apparatus according to claim 11, wherein said charge injection surface layer includes electrically insulative resin material and electroconductive particles.

13. An apparatus according to claim 10, wherein said photosensitive member includes an electrophotographic photosensitive layer inside said charge injection surface layer.

* * * * *